US005346297A

United States Patent [19]

Colson, Jr. et al.

[11] Patent Number: 5,346,297

[45] Date of Patent: Sep. 13, 1994

[54] AUXILIARY STORAGE AND DISPENSING UNIT

[76] Inventors: Angus R. Colson, Jr., 1460 Myrtle, Jamul, Calif. 91935; Linda Pinney, 425 8th St.; Gregory J. Gruzdowich, 13352 Caminito Carmel, both of Del Mar, Calif. 92014; Patrick M. Steusloff, 9414 Keck Ct., San Diego, Calif. 92129

[21] Appl. No.: 361

[22] Filed: Jan. 4, 1993

[51] Int. Cl.[5] ..... E05C 7/06

[52] U.S. Cl. ..... 312/215; 312/222

[58] Field of Search ..... 312/209, 215, 216, 222

[56] References Cited

U.S. PATENT DOCUMENTS 5,206,637 4/1993 Warren ..... 312/222

5,225,825 7/1993 Warren ..... 312/215

*Primary Examiner*—Kenneth J. Dorner

*Assistant Examiner*—Gerald A. Anderson

*Attorney, Agent, or Firm*—John J. Murphey

[57] ABSTRACT

An auxiliary storage and dispensing unit for use with a computer-controlled supply and medication dispenser station including a cabinet having integrally connected top, bottom, side and rear cabinet panels defining a tall storage and interior dispensing cavity accessible through a front opening, a plurality of horizontally openable and closeable doors including door frames and transparent windows hingedly mounted and locked over the front opening, a device for interconnecting one or more doors to allow access to a particular portion of the interior cavity, and a door unlocking device interconnected the computer-controlled station for selectively unlocking one or more of the doors at a particular location on the cabinet as a function of information inputted to the station.

49 Claims, 7 Drawing Sheets

FIG. 7
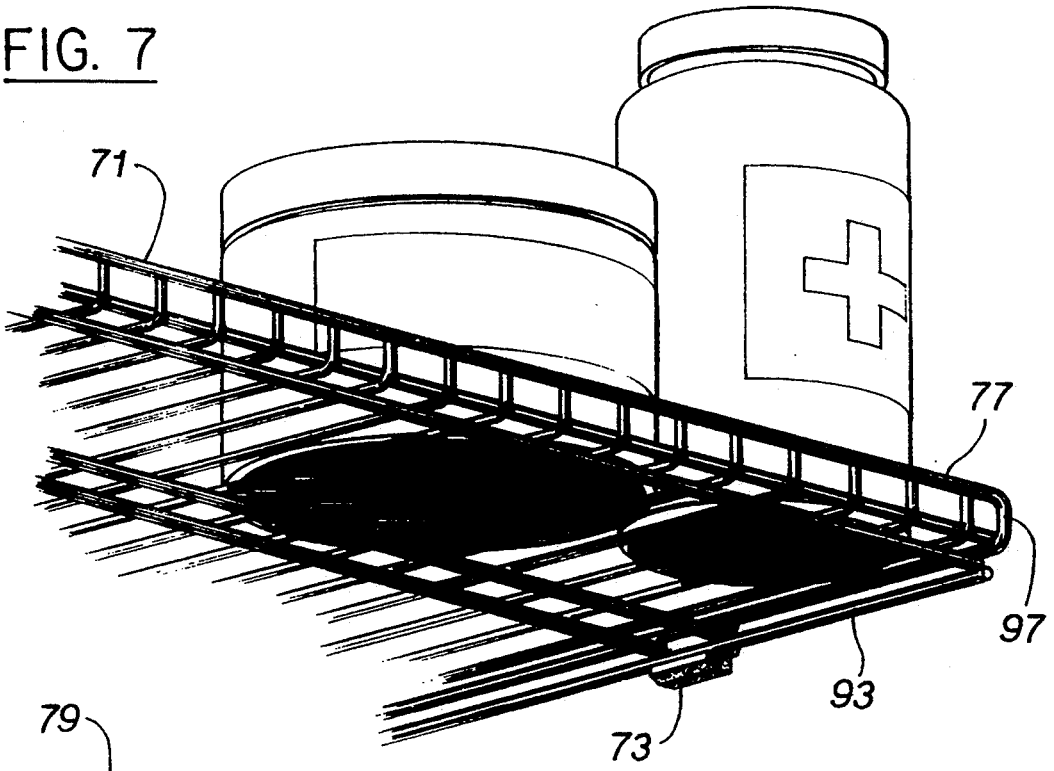
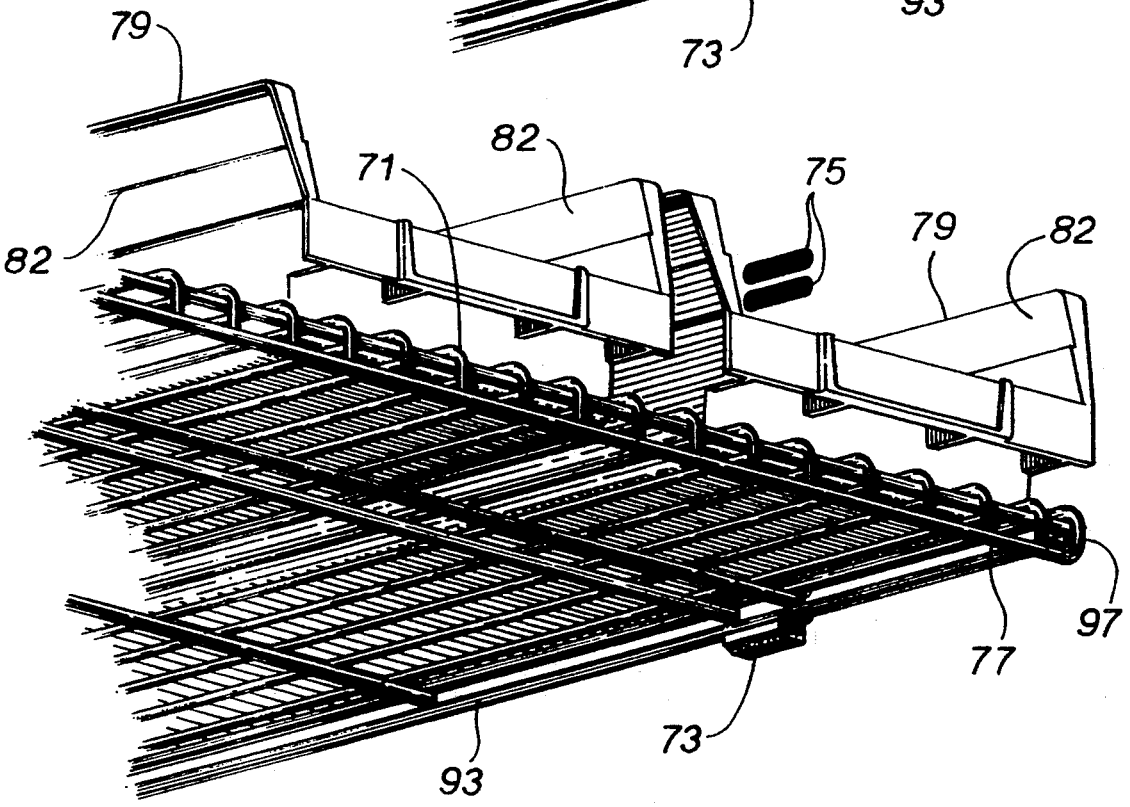
FIG. 8

AUXILIARY STORAGE AND DISPENSING UNIT

BACKGROUND OF THE INVENTION

1. Field of the Invention

This invention pertains to medication or supply dispenser stations for dispensing pharmaceutical and other supply items from locked storage in a hospital, nursing home or other environment where control of supply items are of importance. More particularly, this invention pertains to an auxiliary unit for use with a medication or supply dispenser station for storing and dispensing larger items that are not amenable to storage in the conventional dispenser station.

DESCRIPTION OF THE PRIOR ART

The practice of dispensing pharmaceutical items one at a time from locked storage under strict accountability and security environment is well known. For instance, in many hospitals and nursing homes, medicines are now held under locked storage in medication dispenser stations, such as the one disclosed in U.S. Pat. No. 5,014,875, where nursing personnel retrieve the medicine from locked storage for dispensing, simultaneously and automatically updating the patient's records and billing. While this prior art deals with small items such as syringes, vials and the like, larger hospital items are generally not amenable to storage therein and, in addition, have their own inimitable storage problems.

Large items such as liter bottles of fluids, boxes of diapers, boxes of examination gloves, rolls of bandages, and catheter sets are often too large to be dispensed from the patented dispensing cabinet. Traditionally they are stacked on open shelving where dust and dirt accumulate to interfere with the cleanliness of their use. Where they are housed in a protective layer, they are often stored on shelves over which other items are laid that have sharp corners or are of such a weight that the sterility seal is often broken thereby requiring the item to be discarded without use. Moreover, these items are often stored in dark cabinets where they are soon forgotten or stored in cabinets where they are pushed out of the way during a search for other items. The end result costly, out-of-control inventory management which adds to the expense of operation.

In addition, each hospital carries its own particular designation and stock number for dispensable items used therein. Quite often these hospital designations are different from the common name given to the item. Nursing and other technical personnel transferred from one hospital to another are frequently met with a confusing set of stock numbers and identifiers for particular items thereby providing the basis for over-ordering of some items and overlooking others. Further, these particular supplies are sometimes too bulky to be conveniently held in a small place thereby making it difficult to properly store them. For instance, catheter units are comprised of elongated tubing that cannot be kinked or bent during storage. Without proper handling and storage facility, many of these items are folded over or otherwise damaged so that they are no longer useful. Finally, and just as important, is the problem of putting these items to use without documentation so that they are not properly billed to the patient and their re-ordering is not closely controlled.

All of this leads to a loss of use of particular larger hospital items, either through having their sterility compromised or through lack of use, so that they extend beyond their expiration dates. This adds to the cost of hospital operation and increases the cost to the patient.

SUMMARY OF THE INVENTION

This invention is an auxiliary storage and dispenser unit for use in connection with the supply and medication dispenser station such as the one disclosed in U.S. Pat. No. 5,014,875 and the like. It comprises a tall cabinet made of integrally connected panels that define an interior cavity accessible through a front opening. The front opening is accessed through one or more doors whose size and location along the front of the cabinet may be varied. The doors may be joined together to provide access to larger portions of the interior cavity in the case of large items stored therein. The doors always remain locked against the cabinet, only being opened, on command, to allow a particular item to be removed.

The interior cavity may be modified to different size sub-cavities for storage of a variety of items by the use of shelves. The doors are interconnectable to allow the user to reach different size sub-cavities for holding different size dispensable items. The doors are hinged on only one side of the cabinet and these hinges may be relocated to the opposite side so that they can be opened from either side depending on the desires of the user. The doors are unlockable through use of the same or similar data inputted to the dispensing station for dispensing of smaller items from the station itself so as to controllably dispense the items. Racks are positionable within the storage cavity to hang elongated items therefrom of the type that cannot be contained in smaller packages and/or that cannot be subject to severe bending or kinking operations during storage.

The auxiliary storage cabinet is further of a type amenable to removably house a refrigerator for chilled storage of items which need be dispensed such as certain medicines and medicinal materials that require cooling during storage to prolong their usable life. Electrical lights are provided in the cabinet and may be interconnected with the medication dispenser station to provide local illumination to a specific portion of the storage cavity to direct the user to a particular area to reduce the amount of searching and movement of other items when looking for a particular item. Wheels may be fixed to the bottom of the cabinet to allow it to be moved about and arranged in the most efficient manner to the desires of the user. More than one cabinet may be arranged with a single dispenser station. An emergency panel is provided for access to the unlocking mechanism during power failures to allow manual unlocking of the doors and access to the interior of the cabinet.

Accordingly, the main object of this invention is an auxiliary storage and dispensing unit for use with a computer-controlled medication and supply dispenser station wherein the storage cavity defined within the cabinet is accessible through one or more doors that are interconnected with the computer-controlled station for selectively unlocking one or more of them at a particular location as a function of information inputted to the dispensing station. Other objects of the invention include an auxiliary storage and dispensing unit that is easily modifiable to permit access through doors opening from either side of the front of the cabinet, to interconnect one or more of the doors to provide access to a larger portion of the interior cavity for extracting large items that cannot be easily folded while retaining the lockability of the doors, and to reverse the door's position to open from one side of the cabinet or the other to provide a wide measure of on-site modification available to the user.

Still other objects of the invention includes an auxiliary storage cabinet having moveable partitions to divide the interior storage cavity into smaller cavities for storage and dispensing of smaller items, an auxiliary storage cabinet that includes racks mountable from the underside of the shelves and from the top cabinet panel for hanging dispensable items therefrom that cannot otherwise be conveniently stored; an auxiliary storage unit that will conveniently house a refrigerator in said cavity for chilled storage of dispensable items and for an auxiliary cabinet that has electrical lighting energized in particular to the area of the cavity wherein a particular item is stored. These and other objects of the invention may be determined by reading the following Description of the Preferred Embodiment taken together with the drawings appended hereto. The scope of protection sought by the inventor may be gleaned from a close reading of the claims that conclude this specification.

Figure 9:
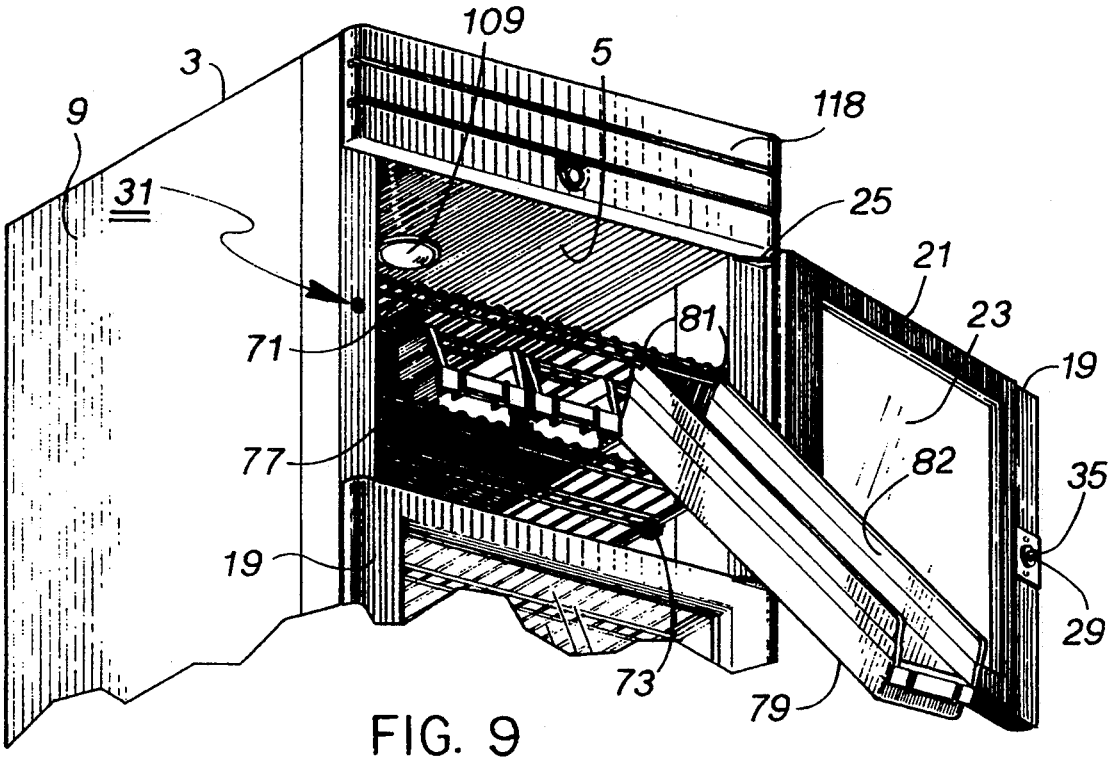
Figure 10:
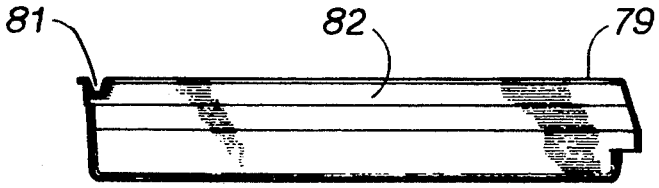
Figure 11:
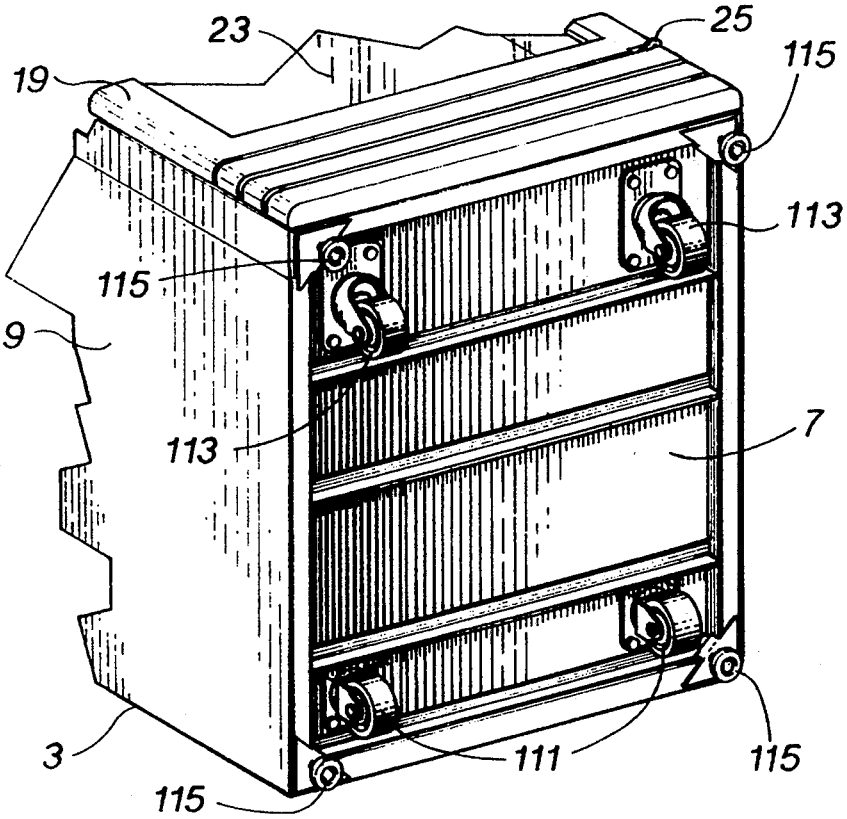
Figure 12:
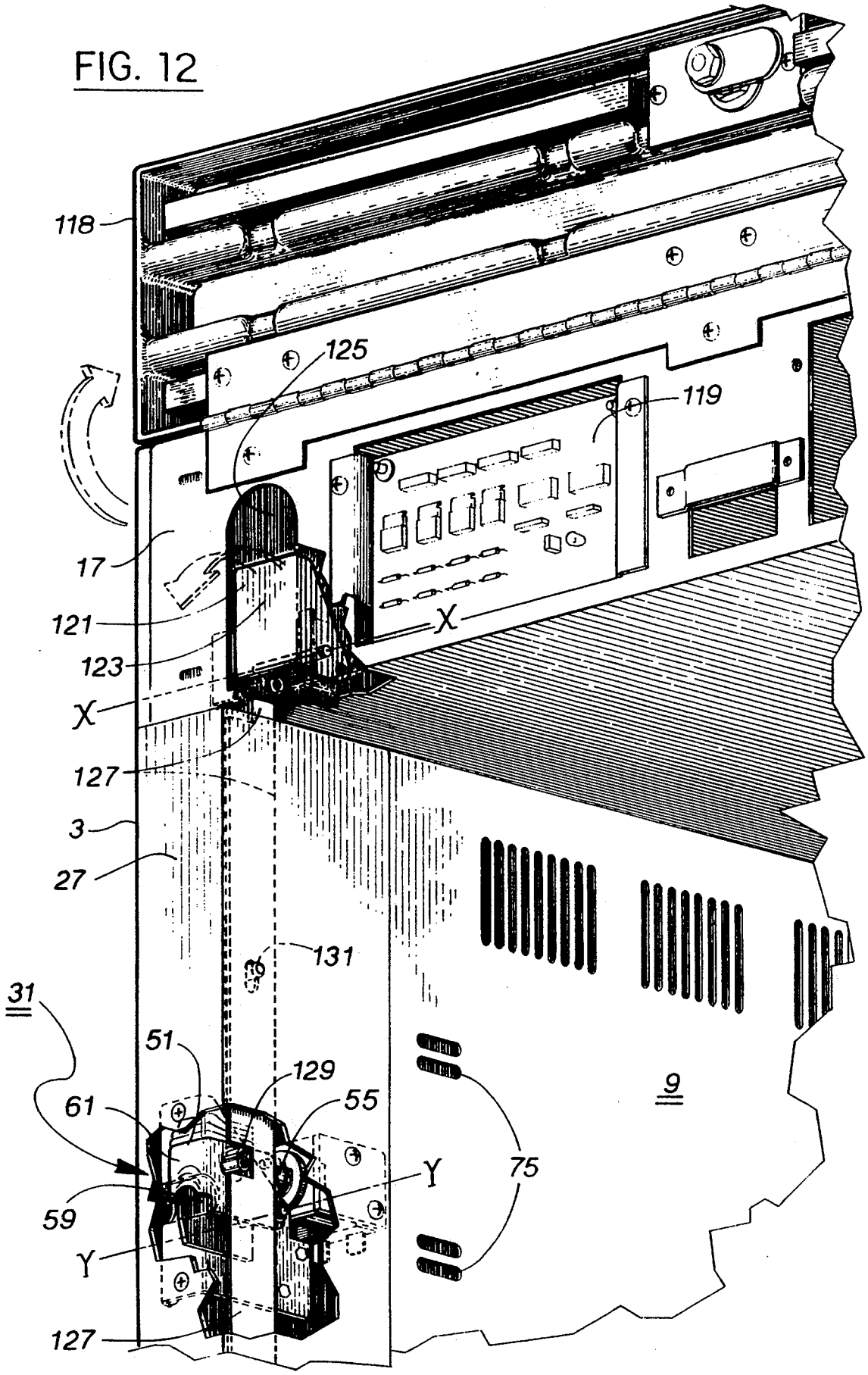

FIGS. *6a*, *6b* and *6c* are trimetric views of a portion of the inside side wall of the cabinet showing the shelf bracket assembly sequence and contacted by the shelf as it is being pulled forward;

FIG. 7 is a trimetric view of a portion of a wire shelf with the front edge turned up;

FIG. 8 is the same view as in FIG. 7, with the wire shelf having a front edge that is turned down;

FIG. 9 is a trimetric view of a portion of the front of the cabinet with a storage bin pulled out and then rotated downward into an access hold position;

FIG. 10 is a side elevational view of the storage bin shown in FIG. 9;

FIG. 11 is a trimetric view of the bottom of the cabinet showing fixed and swivel casters and leveling pads; and, FIG. 12 is a trimetric view of a portion of the front of the cabinet showing the manual door unlock system, with cutaways for clarity.

DESCRIPTION OF THE PREFERRED EMBODIMENT

Figure 1:
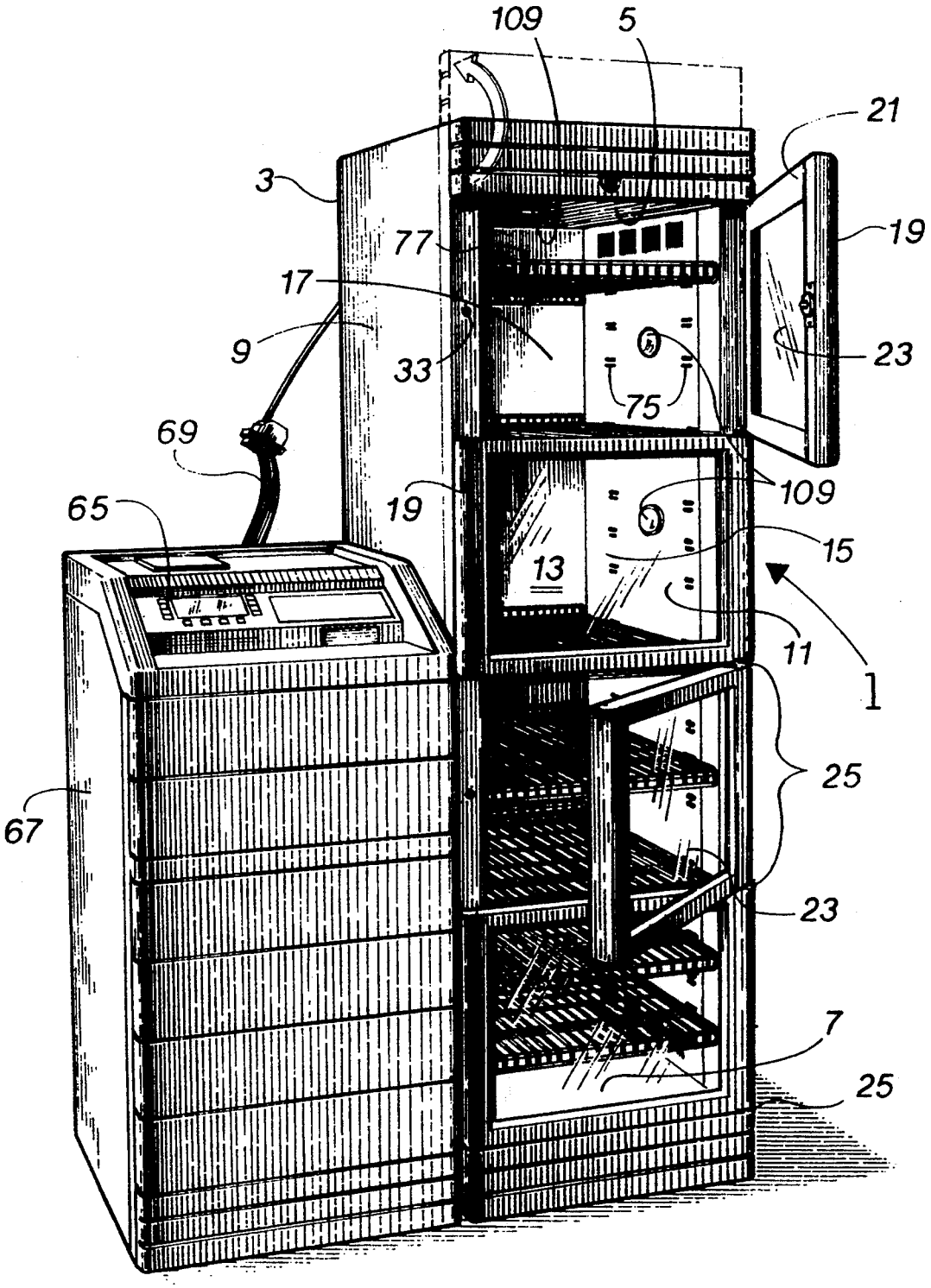
FIG. 1 is an illustrative view of the preferred embodiment of the auxiliary storage and dispensing unit of this invention shown positioned adjacent an interconnected supply or medication dispenser station of the type disclosed in U.S. Pat. No. 5,014,875 showing said cabinet to be divided into sub-cavities by a plurality of partitions or shelves.

Referring to the drawings where like numerals identify like elements throughout the fourteen drawings, the invention 1 is shown in FIG. 1 to comprise a tall cabinet 3 made up of spaced-apart top and bottom panels 5 and 7, respectively, joined about three of their marginal edges by spaced-apart side panels 9 and 11, respectively, and a rear cabinet panel 13 integrally connected along their mutually adjacent marginal edges such as by welding or other secure fastening. As shown, panels 5 through 13 define an interior dispensing cavity 15 accessible through a front opening 17 that is defined by the respective edges of top and bottom panels 5 and 7 and side panels 9 and 11.

Figure 2:
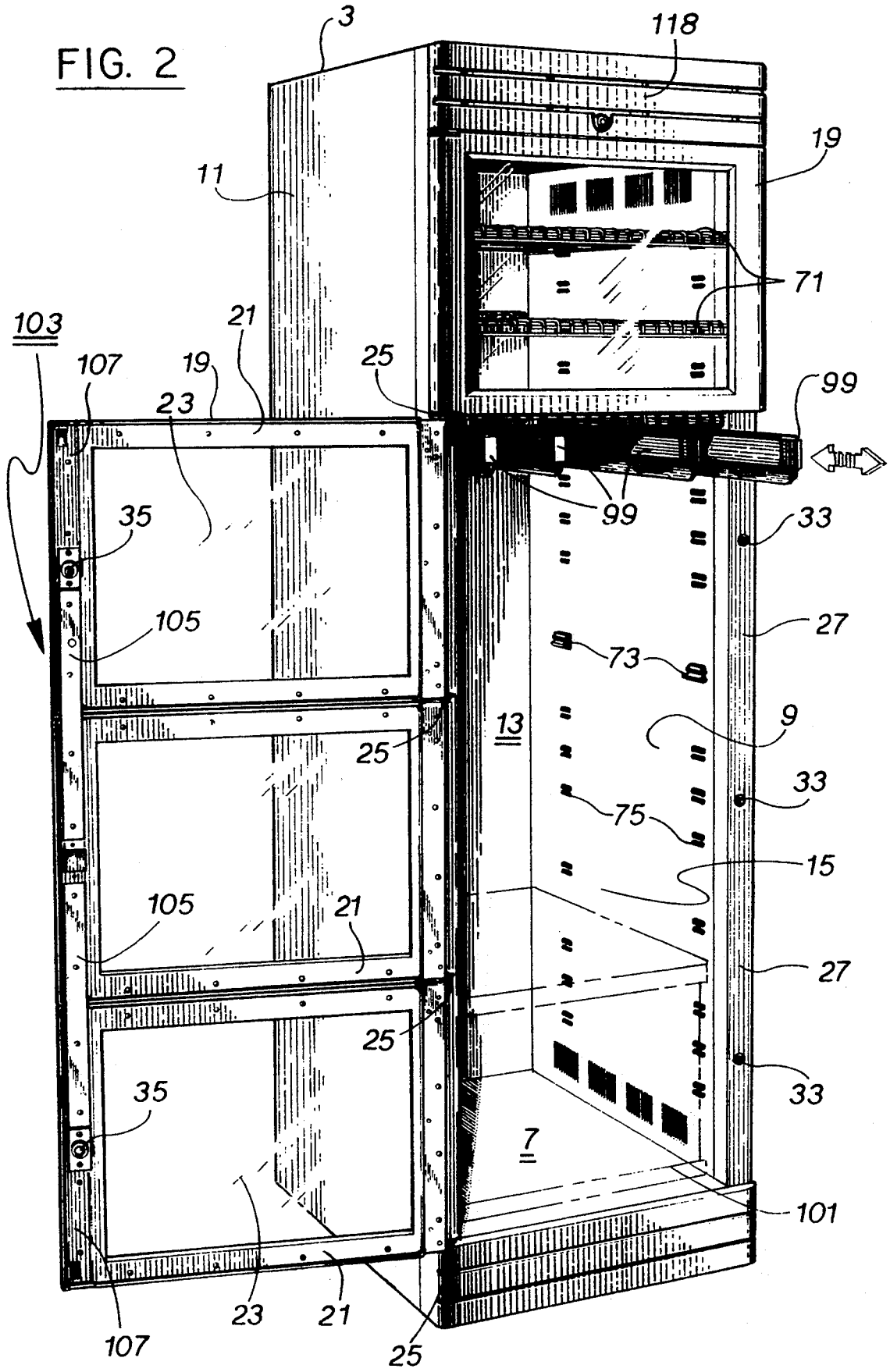
FIG. 2 is an illustrative view of the embodiment shown in FIG. 1 showing certain of the doors to be interconnected and opening from the opposite side and sliding hanger units positioned at the top of the enlarged interior cavity.

As shown in FIGS. 1 and 2, a plurality of doors 19, each comprising an integral door frame 21 surrounding a transparent window 23 is pivotally mounted by hinges 25 attached to the front edge 27 of side panel 11 to be openable and closeable over cavity 15 by a latch 29 (see FIG. 4), located on one or more doors 19, that is received in a locking/unlocking means 31 (see FIGS. 5, 9 and 12) mounted behind an aperture 33 in side panel 11.

Figure 5:
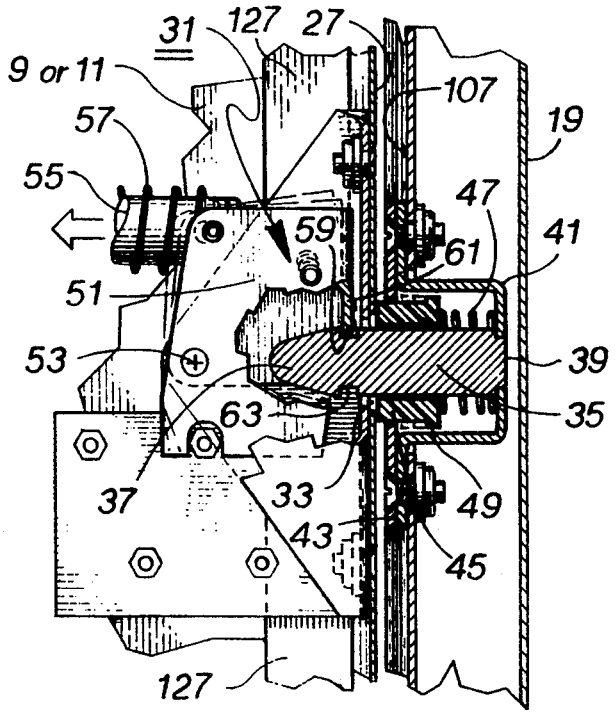
FIG. 5 is a side elevational view, partly in section, of the door latch taken along line 5—5 in FIG. 4.
Figure 4:
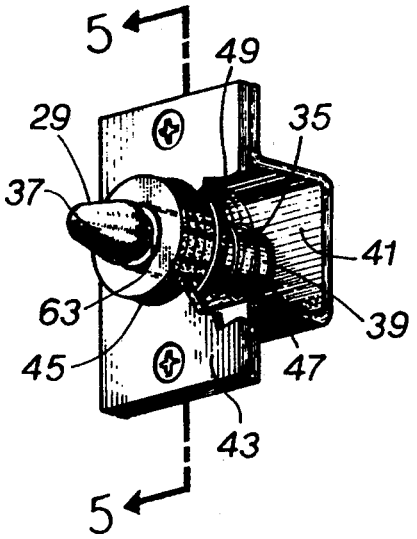
FIG. 4 is a trimetric view of the door catch assembly ready to be mounted in a door of the cabinet.

As shown in FIGS. 4 and 5, latch 29 comprises a solid bolt 35 having a conically pointed latching end 37 and an opposite base end 39 that is mounted against a wall 41 making up a frame 43. A sleeve 45 is reciprocally mounted over bolt 35, biased outward toward latching end 37 by a spring 47, and restrained from further motion by a stop collar 49 mounted on sleeve 45.

As further shown in FIGS. 5 and 12, locking/unlocking means 31 comprises a bracket 51 pivotally mounted by a shaft 53 attached to a pull rod 55 that is biased forward by a spring 57. A notch 59 is formed in bracket 51 aligned with bolt 35 to allow insertion of conically pointed bolt latching end 37. As door 19 is closed, bolt 35 enters notch 59 and is temporarily captured therein by a latch plate 61 on bracket 51 that drops down behind conical latching end 37 into a groove 63 formed about the base of end 37. Simultaneously, sleeve 45 is pushed backward into frame 43 and against the bias pressure from spring 47.

As set forth in the aforesaid supply or medication dispensing station patent, information inputted to a keyboard 65 (see FIG. 1) positioned near the top surface of the supply dispenser station 67, concerning the particular dispensable item needed for a patient and information as to the party entering the information, will cause electrical impulses to be issued from dispenser station 67 through a cable 69 to actuate a particular electric solenoid located inside panel 9 (not shown) to allow a particular door 19 to unlock by pulling on pull rod 55 to lift latch plate 61 and allow sleeve spring 47 to push the door partially open to permit access to the interior of cabinet 3 and simultaneously and automatically update the patient's record and hospital inventory.

As shown in FIGS. 1, 2, 7, 8 and 9, a plurality of wire shelves or partitions 71 are insertable and mountable in spaced-apart pairs of slide fittings 73 inserted in slots 75 inside cabinet cavity 15 on each side thereof to permit cavity 15 to be divided into a plurality of sub-cavities either of the same size or of a variety of sizes depending upon the requirements of the particular dispensable item to be stored therein. Shelves 71 may have an upwardly or downwardly turned front edge 77 to either prevent items from slipping forward and out of the sub-cavity during loading and/or dispensing, or to prevent a bin 79 set below on the next shelf from falling out of cavity 15 (see FIG. 9).

FIG. 7 shows how an upwardly turned front edge is used to prevent items from falling out of the cabinet while FIGS. 9 and 10 show how a notch 81, formed at the upper rear of bin side walls 82 can lock with the downwardly turned edge 77 to keep from falling from the cabinet.

It is preferred that each shelf have one upwardly turned edge 77 and a downwardly turned edge 77 in mutually opposed spaced-apart arrangement. In this manner, to change from one to the other requires only the shelf to be removed from cabinet interior cavity 15, rotated in a horizontal plane 180°, then put back into said cavity. When the shelf is placed in the cabinet to have its upwardly turned edge at the front, the downwardly turned edge will be at the rear thereof.

Figure 6A:
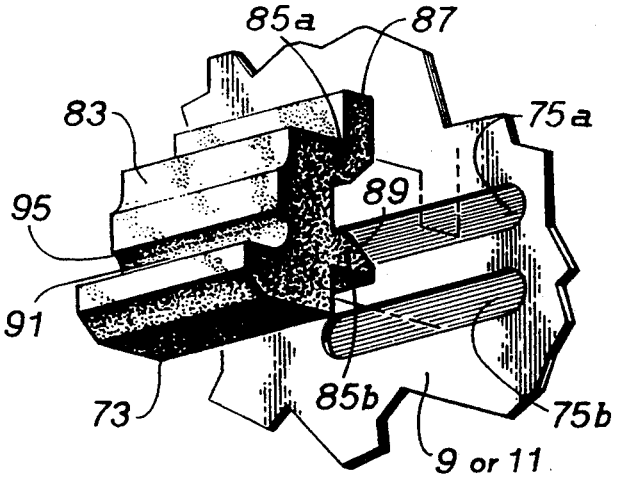
Figure 6B:
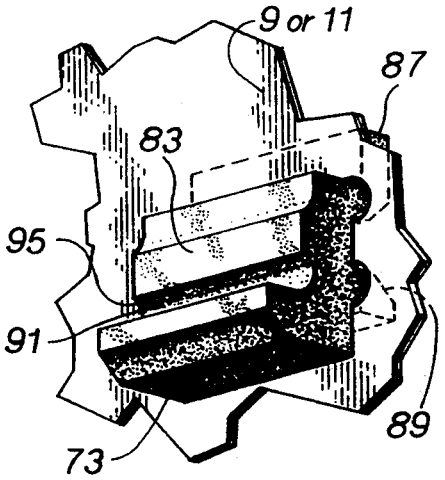

Further, as shown in FIGS. 7 and 8, shelves 71 may be of the variety that can be moved inward and outward such as on slide fittings 73 from cavity 15 to facilitate placement of items for storage and removal of dispensable items. With respect to slide fittings 73, the preferred embodiment is shown in FIGS. 6*a* and 6*b* to comprise a body 83 and a pair of spaced-apart first and second mounting legs 85*a* and 85*b* extending therefrom respectively that are received in parallel slots 75*a* and 75*b*. First leg 85*a* includes an upwardly turned portion 87, adapted to bear against the inside of cabinet side panel 9 or 11, depending upon which side panel it is mounted, and second leg 85*b* contains a beveled surface 89 to assist in inserting fittings 73 in slots 75*a* and 75*b*. A shelf-carrying groove 91 is formed in body 83, opposite from legs 85*a* and 85*b*, for supporting the lower rail or wire 93 forming the horizontal edge of shelf 71 (see FIGS. 6*c*, 7 and 8).

Figure 6C:
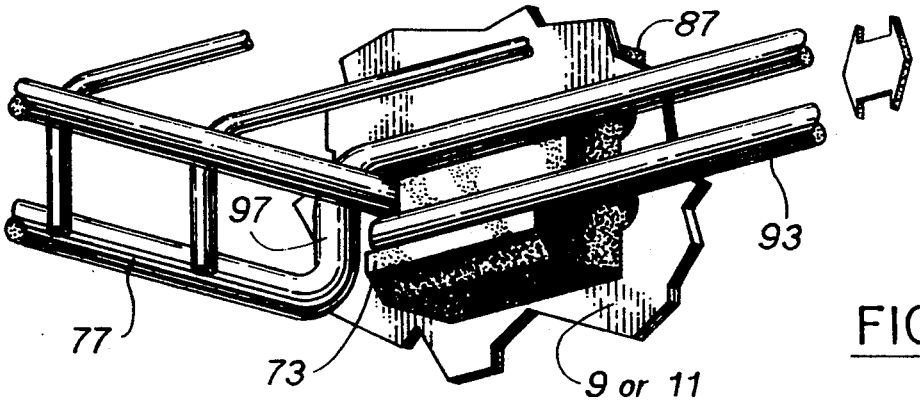

An inwardly directed groove wall segment 95 is formed in groove 91, above the lower half of groove 91, for bearing against the upper surface of lower rail 93 to prevent the shelf from tilting upward in the rear as shelf 71 is pulled out along groove 91 to expose items stored thereon. As shown in FIG. 6*c*, a vertical post 97 is formed at the rear of shelf 71 and arranged at the side thereof to abut the rear-most slide fitting 73 after it pulled forward out of cavity 15 to prevent said shelf from being pulled completely out of said cavity during normal use thereof. Should it be desired to remove shelf 71 completely from cavity and relocate it elsewhere in said cavity, the shelf is pulled forward until post 97 abuts fitting 73, then side panel 9 (or 11) is temporarily distorted outward (called "oil canning") to allow the shelf to clear fitting 73 and be totally removed from cavity 15. Fittings 73 are then removed from slots 75 and relocated elsewhere in side walls 9 and 11 to thereafter receive shelf therein.

A plurality of extensible racks 99 are provided, as shown in FIG. 2, for mounting on the underside of a shelf 71 to be pulled forward out of cavity 15 for hanging dispensable items therefrom such as intravenous and catheter units and then to be moved back inside cavity 15 for storage. Other forms of tall items may be conveniently stored in this upwardly elongated sub-cavity such as crutches, packages of stacked facial tissue and the like. Racks 99 may also be mountable on the underside of top panel 5 as well to provide a substantially larger elongated cavity for storage.

Figure 3:
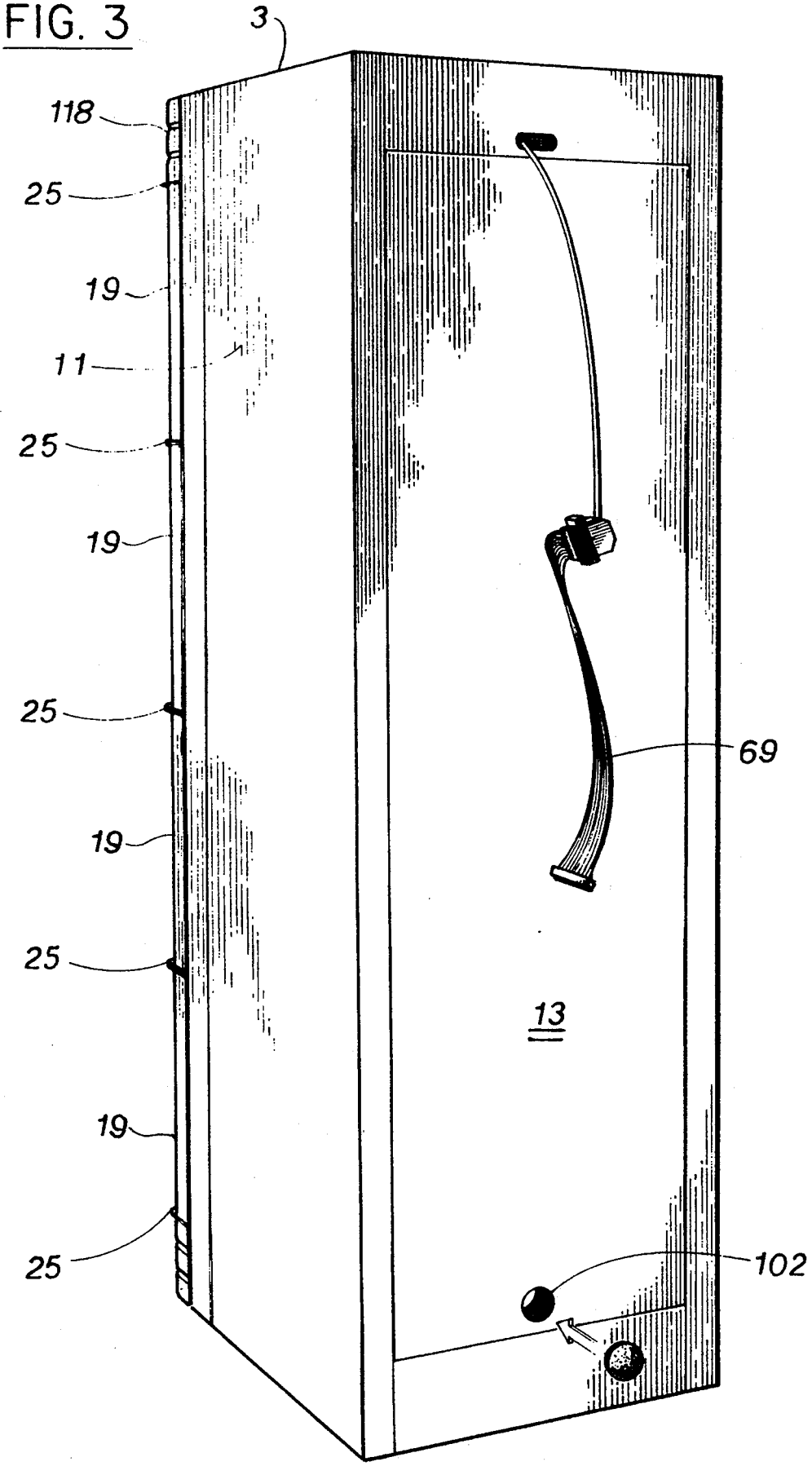
FIG. 3 is an illustrative view of the rear of the embodiment shown in FIG. 1 with a computer "pigtail" cable ready to be connected to a dispensing station and a removable plug at the base.

Shown in dotted outline in FIG. 2 is a small electric refrigerator 101 stored in the lower portion of cabinet cavity 15 to retain therein in chilled storage certain dispensable items such as medicines and the like whose storage requires a lower temperature. The gradual upward flow of warm, dry air from the refrigerator's exterior-mounted heat exchanger through cavity 15 helps retain the items stored therein at a relatively low humidity. This also appears to help keep dust from entering the cavity thus retaining the stored items substantially free of contaminants. The electric cord used to connect refrigerator 101 to an external power source may be passed out through a pluggable opening 102 formed in rear cabinet wall 13 as shown in FIG. 3.

Means 103 is provided for interconnecting one or more doors 19 to provide access to a larger sub-cavity than is possible by a single door, to store and to dispense elongated items such as catheters and crutches. As shown in FIG. 2, means 103 preferably includes one or more elongated metal or other hard straps 105 inserted and bolted, screwed or otherwise affixed in the rear face 107 of door frame 21 spanning two adjacent doors, to interconnect them and allow the interconnected doors to be opened and closed as one complete unit. In such a configuration, locking/unlocking means 31 may comprise only one, a few, or all of the unlocking solenoids and hardware associated with each individual door. Where only one locking and unlocking means 31 is used, the computer in supply dispenser station 67 must be programmed to allow access to the interconnected doors by disengaging the unlocking electrical solenoid for the other door or doors. Where the locking/unlocking mechanisms for each door are to be utilized, the computer in medication dispenser station 67 must be programmed to actuate the solenoids for each of the doors in unison to allow simultaneous unlocking of all of them.

As shown in FIG. 2, interior cavity 15 may be divided by a combination of interconnecting some of the doors to provide upwardly elongated storage sub-cavities for storage of elongated items therein, while at the same time providing smaller sub-cavities for storage of substantially smaller items thereabove or below.

As shown in FIGS. 1 and 2, doors 19 may be arranged to open from different sides of cabinet 3. This is preferably accomplished by arranging hinges 25 and locking/unlocking means 31 to be fully interchangeable so that door 19 may be reversed 180° to thereafter be hinged on the opposite side of cabinet 3 and the door used in an "upside down" configuration. Door frame 21 is conveniently made with consistent measurements top and bottom and from side-to-side so that reversing it poses no problem to the operation of the cabinet.

While not specifically shown, a plurality of cabinets 3 may be utilized and interconnected with one particular supply or medication dispenser station 67 through cables 69 and provide various sized sub-cavities within each cabinet for the storage of dispensable items. Through the use of adjustable shelves 71, and the ability to make doors 19 open from one side or the other, combination with means 103 for joining specific doors in a unitary door combination, this invention is capable of a wide range of storage and dispensing configurations.

Electrical lighting is provided interior of cabinet 3. As shown in FIGS. 1 and 9, a series of individual electric lamps 109 is placed throughout cavity 15, in panels 5–13, for illuminating the items stored therein. To aid the user, the information inputted keyboard 65 on dispenser station 67 may be programmed to cause not only the appropriate door to unlock for opening but also the appropriate lamp or lamps in the sub-cavity wherein the dispensable items are stored to illuminate. This feature reduces the amount of searching by the user and promotes efficiency in the use of the medication dispenser station. It also helps the user locate items that may be carried under an unfamiliar stock number or other identifier code.

As shown in FIG. 11, a pair of fixed wheels 111 and a pair of casters 113 are mounted under cabinet 3 for aid in positioning it. Adjustable levelling mechanisms 115 are also mounted under cabinet 3 in the corners to aid in leveling the cabinet.

As shown in FIG. 12, an emergency access panel 117 is mounted at the top front of cabinet 3, covered over by a liftable locked cover plate 118 that may be unlocked and raised to expose the electronic control circuit board 119 and the emergency door opening mechanism 121, the latter usable in event of a total loss of electrical power to supply dispensing station 67 or a malfunction in keyboard 65 or its related components. Door opening mechanism 121 comprises a handle 123 pivotally mounted along an axis x—x in a cubby hole 125 formed in access panel 117 connected to an elongated strap 127 slidably mounted inside panel front edge 27 with strap slide pins 131 and extending down inside cabinet side panel 9 or 11. Strap 127 has openings formed therein that align with and are larger than reversible pins 129 that are connected to inside face of brackets 51 in means 31. Strap 127 has a hole formed therein closely located about an actuating pin 129 affixed to each bracket 51. As handle 123 is pulled downward, in the direction of the arrow in FIG. 12, strap 127 is moved upward thereby lifting and rotating brackets 51 about axis y—y in unison so that the individual latch plates 61 are raised from grooves 53 to allow each door to be opened. The spring bias on sleeve 45 quickly moves outward against panel front edge 27 to partially move the doors through an arc and away from front edge 27.

While the invention has been described with reference to a particular embodiment hereof, those skilled in the art will be able to make various modifications to the described embodiment of the invention without departing from the true spirit and scope thereof. It is intended that all combinations of elements and steps which perform substantially the same function in substantially the way to achieve substantially the same results are within the scope of this invention.

What is claimed is:

1. An auxiliary storage and dispensing unit for use in combination with a separate computer-controlled supply and medication dispenser station, said station including a keyboard for inputting coded information concerning the particular dispensable items needed for a patient and information as to the party entering the information, that causes electrical impulses to be issued therefrom in conformance with such information, comprising:

a) a cabinet having integrally connected top, bottom, side and rear cabinet panels defining a tall storage and interior dispensing cavity accessible through a front opening;

b) a plurality of horizontally openable and closeable doors including door frames and transparent windows hingedly mounted and lockable over said front opening;

c) means for locking said doors when they are closed over said front opening; and, d) door unlocking means interconnectable with the computer-controlled station and said locking means for receipt of said electrical impulses from said station to selectively unlock one or more of said doors at a particular location on said cabinet as a function of information inputted to said station.

2. The auxiliary storage and dispensing unit of claim 1 where said plurality of doors is arranged to open from one side of said cabinet.

3. The auxiliary storage and dispensing unit of claim 2 including means to reverse the doors to open from the opposite side of said cabinet.

4. The auxiliary storage and dispensing unit of claim 1 further including partitions to divide said cavity into vertically smaller sub-cavities for storage and dispensing smaller items therefrom.

5. The auxiliary storage and dispensing unit of claim 4 further including an upwardly turned front lip formed on said partitions to aid in retaining the items stored thereon.

6. The auxiliary storage and dispensing unit of claim 4 further including a downwardly turned front lip formed on said partitions to aid in retaining the items stored thereon.

7. The auxiliary storage and dispensing unit of claim 4 wherein said partitions include an upwardly turned front lip and a downwardly turned rear lip spaced-apart therefrom so that by rotating said partition 180° said downwardly turned rear lip may be relocated to the front of said partition.

8. The auxiliary storage and dispensing unit of claim 4 further including moveable racks mountable on the underside of said partitions for hanging dispensable items therefrom.

9. The auxiliary storage and dispensing unit of claim 1 further including moveable racks mountable on the underside of said top cabinet panel for hanging dispensable items therefrom.

10. The auxiliary storage and dispensing unit of claim 1 further including spaced-apart pairs of slide fittings interposed said partitions and said side panels wherein each said fitting comprises:

a) a fitting body;

b) a pair of spaced-apart first and second legs extending therefrom for insertion in a pair of slots formed in each said cabinet side panel;

c) said first leg having an upwardly turned portion adapted to bear against the inside of said cabinet side panel after insertion into said slot;

d) said second leg having a beveled surface formed thereon to assist in mounting said fitting in said slots;

e) a partition carrying groove formed in said body opposite said legs for supporting said partition in sliding arrangement thereacross; and, f) an inwardly directed wall segment of said groove formed above the lower half thereof, for bearing against an upper surface of said partition to prevent said partition from tilting downward during withdrawal from said cabinet to expose items stored thereon.

11. The auxiliary storage and dispensing unit of claim 1 further including a refrigerator temporarily retained in said cavity for chilled storage of dispensable items.

12. The auxiliary storage and dispensing unit of claim 1 further including electrical lighting lamps mounted interior said cabinet and means for energizing a particular lamp to illuminate a portion of said cavity wherein the desired dispensable item is stored.

13. The auxiliary storage and dispensing unit of claim 1 further including wheels on which to move said cabinet.

14. The auxiliary storage and dispensing unit of claim 1 further including an emergency access panel covered by a locked cover plate that may be unlocked to expose an emergency door opening mechanism for unlocking said cabinet doors in the event of a power failure.

15. The combination of claim 1 further including means for interconnecting one or more doors to allow access to a particular portion of said interior cavity.

16. The auxiliary storage and dispensing unit of claim 15 wherein said means for interconnecting one or more of said doors includes an elongated strap for insertion across the door frames of two or more adjacent doors.

17. The auxiliary storage and dispensing unit of claim 1 wherein said door unlocking means includes an electric solenoid actuated by electric pulses received from the medication dispenser station to selectively unlock a specific door lock as a function of information inputted at said station.

18. An auxiliary storage and dispensing unit for use with a computer-controlled supply and medication dispenser station, said station including a keyboard for inputting coded information concerning the particular dispensable items needed for a patient and information as to the party entering the information, that causes electrical impulses to be issued therefrom in conformance with such information, comprising:

a) a cabinet having integrally connected top, bottom, side and rear cabinet panels defining a tall storage and interior dispensing cavity accessible through a front opening;

b) a plurality of horizontally openable and closeable reversible doors including door frames and transparent windows hingedly mounted and lockable over said front opening and including a latch mounted on each said doors;

c) means for locking said doors, using said latch, when they are closed over said front opening;

d) door unlocking means interconnectable with the computer-controlled station for selectively unlocking one or more of said doors at said latch at a particular location on said cabinet as a function of information inputted to said station; and, e) horizontal partitions to divide said cavity into vertically smaller sub-cavities for storage and dispensing smaller items therefrom.

19. The auxiliary storage and dispensing unit of claim 18 further including a downwardly turned front lip formed on said shelves to aid in retaining the items stored thereon.

20. The auxiliary storage and dispensing unit of claim 18 wherein said shelves include an upwardly turned front lip and a downwardly turned rear lip spaced-apart therefrom so that by rotating said shelf 180° said downwardly turned rear lip may be relocated to the front of said partition.

21. The auxiliary storage and dispensing unit of claim 18 further including means for interconnecting one or more doors to allow access to a particular portion of said interior cavity.

22. The auxiliary storage and dispensing unit of claim 18 further including spaced-apart pairs of slide fittings interposed said partitions and said side panels wherein each said fitting comprises:

a) a fitting body;

b) a pair of spaced-apart first and second legs extending therefrom for insertion in a pair of slots formed in each said cabinet side panel;

c) said first leg having an upwardly turned portion adapted to bear against the inside of said cabinet side panel after insertion into said slot;

d) said second leg having a beveled surface formed thereon to assist in mounting said fitting in said slots;

e) a partition carrying groove formed in said body opposite said legs for supporting said partition in sliding arrangement thereacross; and, f) an inwardly directed wall segment of said groove formed above the lower half thereof, for bearing against an upper surface of said partition to prevent said partition from tilting downward during withdrawal from said cabinet to expose items stored thereon.

23. The auxiliary storage and dispensing unit of claim 18 further including a refrigerator temporarily retained in said cavity for chilled storage of dispensable items.

24. The auxiliary storage and dispensing unit of claim 18 further including electrical lighting lamps mounted interior said cabinet and means for energizing a particular lamp to illuminate a portion of said cavity wherein the desired dispensable item is stored.

25. The auxiliary storage and dispensing unit of claim 18 further including wheels on which to move said cabinet.

26. The auxiliary storage and dispensing unit of claim 18 further including an emergency access panel covered by a locked cover plate that may be unlocked to expose an emergency door opening mechanism for unlocking said cabinet doors in the event a power failure.

27. The auxiliary storage and dispensing unit of claim 18 wherein said means for interconnecting one or more of said doors includes an elongated strap for insertion across the door frames of two or more adjacent doors.

28. The auxiliary storage and dispensing unit of claim 18 wherein said door locking/unlocking means includes an electric solenoid actuated by electric pulses received from the medication dispenser station to selectively unlock a specific door lock as a function of information inputted at said station.

29. The auxiliary storage and dispensing unit of claim 18 wherein said latch comprises:

a) a bolt having a latching end and an opposite base end;

b) said base end mounted against a wall making up a frame for attachment to said door;

c) a sleeve slidingly mounted over said bolt and biased outward from said door; and, d) a stop collar mounted on said frame to restrict the movement of said sleeve.

30. The auxiliary storage and dispensing unit of claim 29 wherein said door locking/unlocking means comprises:

a) a bracket pivotally mounted in said side panel;

b) a pull rod pivotally attached to said bracket;

c) a spring biasing said rod in a forward position toward said door;

d) said bracket forming an opening aligned with said bolt during closure of said door; and, e) a latch plate attached to said bracket arranged to drop downward over said bolt latching end to temporarily capture said bolt therein when said door is closed on said cabinet;

f) wherein a pulling force applied to said rod will pivot said bracket and latch plate upward freeing said bolt to allow said bolt sleeve to move forward under bias pressure and open said door.

31. The auxiliary storage and dispensing unit of claim 18 further including an upwardly turned front lip formed on said shelves to aid in retaining the items stored thereon.

32. The auxiliary storage and dispensing unit of claim 31 further including means for interconnecting one or more doors to allow access to a particular portion of said interior cavity.

33. In combination, a computer-controlled supply and medication dispenser station, including a keyboard mounted thereon for inputting coded information concerning the particular dispensable items needed for a patient and information as to the party entering the information, that causes electrical impulses to be issued therefrom in conformance with such information, and an auxiliary storage and dispensing unit for use therewith, said unit comprising:

a) a cabinet having integrally connected top, bottom, side and rear cabinet panels defining a tall storage and interior dispensing cavity accessible through a front opening;

b) a plurality of horizontally openable and closeable doors including door frames and transparent windows hingedly mounted and lockable over said front opening;

c) means for locking said doors when they are closed over said front opening; and, d) door unlocking means interconnected said computer-controlled station and said locking means for receipt of said electrical impulses from said station to selectively unlock one or more of said doors at a particular location on said cabinet as a function of information inputted to said station.

34. The combination of claim 33 including means reversing the doors to open from the opposite side of said cabinet.

35. The combination of claim 33 further including partitions to divide said cavity into vertically smaller sub-cavities for storage and dispensing smaller items therefrom.

36. The combination of claim 35 further including an upwardly turned front lip formed on said partitions to aid in retaining the items stored thereon.

37. The combination of claim 35 further including a downwardly turned front lip formed on said partitions to aid in retaining the items stored thereon.

38. The combination of claim 35 wherein said partitions include an upwardly turned front lip and a downwardly turned rear lip spaced-apart therefrom so that by rotating said partition 180° said downwardly turned rear lip may be relocated to the front of said partition.

39. The combination of claim 35 further including moveable racks mountable on the underside of said partitions for hanging dispensable items therefrom.

40. The combination of claim 35 further including spaced-apart pairs of slide fittings interposed said partitions and said side panels wherein each said fitting comprises:

a) a fitting body;

b) a pair of spaced-apart first and second legs extending therefrom for insertion in a pair of slots formed in each said cabinet side panel;

c) said first leg having an upwardly turned portion adapted to bear against the inside of said cabinet side panel after insertion into said slot;

d) said second leg having a beveled surface formed thereon to assist in mounting said fitting in said slots;

e) a partition carrying groove formed in said body opposite said legs for supporting said partition in sliding arrangement thereacross; and, f) an inwardly directed wall segment of said groove formed above the lower half thereof, for bearing against an upper surface of said partition to prevent said partition from tilting downward during withdrawal from said cabinet to expose items stored thereon.

41. The combination of claim 33 further including moveable racks mountable on the underside of said top cabinet panel for hanging dispensable items therefrom.

42. The combination of claim 33 further including a refrigerator temporarily retained in said cavity for chilled storage of dispensable items,

43. The combination of claim 33 further including electrical lighting lamps mounted interior said cabinet and means for energizing a particular lamp to illuminate a portion of said cavity wherein the desired dispensable item is stored.

44. The combination of claim 33 further including wheels on which to move said cabinet.

45. The combination of claim 33 further including an emergency access panel covered by a locked cover plate that may be unlocked to expose an emergency door opening mechanism for unlocking said cabinet doors in the event of a power failure.

46. The combination of claim 33 wherein said plurality of doors is arranged to open from one side of said cabinet.

47. The combination of claim 33 wherein said door unlocking means includes an electric solenoid actuated by said electric pulses received from said medication dispenser station to selectively unlock a specific door lock as a function of information inputted to said station.

48. The combination of claim 33 further including means for interconnecting one or more of said doors to allow access to a particular portion of said interior cavity.

49. The combination of claim 48 wherein said means for interconnecting one or more of said doors includes an elongated strap for insertion across the door frames of two or more adjacent doors.

* * * * *